United States Patent [19]

Linecker

[11] 4,310,170

[45] Jan. 12, 1982

[54] CROSS-COUNTRY SKI BINDING

[76] Inventor: Josef Linecker, Rosengasse 5, Mattighofen, Austria

[21] Appl. No.: 97,882

[22] Filed: Nov. 28, 1979

[30] Foreign Application Priority Data

Dec. 4, 1978 [AT] Austria ..... 8663/78

[51] Int. Cl.[3] ..... A63C 9/00

[52] U.S. Cl. ..... 280/636; 280/607; 280/615; 280/633

[58] Field of Search ..... 280/633, 636, 614, 615, 280/617, 611, 607; 9/310 AA

[56] References Cited

U.S. PATENT DOCUMENTS

| | | | |
|---|---|---|---|
| 3,750,204 | 8/1973 | Walter | 280/633 X |
| 3,775,866 | 12/1973 | Marker | 280/615 X |
| 3,807,748 | 4/1974 | Ramillon | 280/633 |
| 3,977,688 | 8/1976 | Imagawa | 280/607 X |
| 4,082,312 | 4/1978 | Johnson | 280/636 X |
| 4,196,921 | 4/1980 | Sherwin | 280/615 |

FOREIGN PATENT DOCUMENTS

| | | | |
|---|---|---|---|
| 317742 | 9/1974 | Austria . | |
| 2639167 | 3/1978 | Fed. Rep. of Germany | 280/615 |
| 99020 | 9/1961 | Norway | 280/607 |
| 340170 | 9/1959 | Switzerland | 280/636 |

*Primary Examiner*—Joseph F. Peters, Jr.
*Assistant Examiner*—Milton L. Smith
*Attorney, Agent, or Firm*—Kurt Kelman

[57] ABSTRACT

A cross-country ski binding for use with a ski shoe having a recessed sole area has a guiding plate affixed to the ski, a bearing plate and a heel part arranged on the bearing plate. The guiding plate has an upper surface defining a plurality of transverse depressions. The bearing plate is of elastic material and is longitudinally slidably mounted on the guiding plate. It includes a projection matching the depressions for selectively engaging a respective depression for retaining the bearing plate in a selected longitudinal position relative to the guiding plate and an extension projecting longitudinally beyond the bearing plate and having an underside rising from the upper surface of the guiding plate. The heel part has a raised portion matching the recessed sole area for engagement therewith.

5 Claims, 4 Drawing Figures

Figures 1, 2, 3, 4:
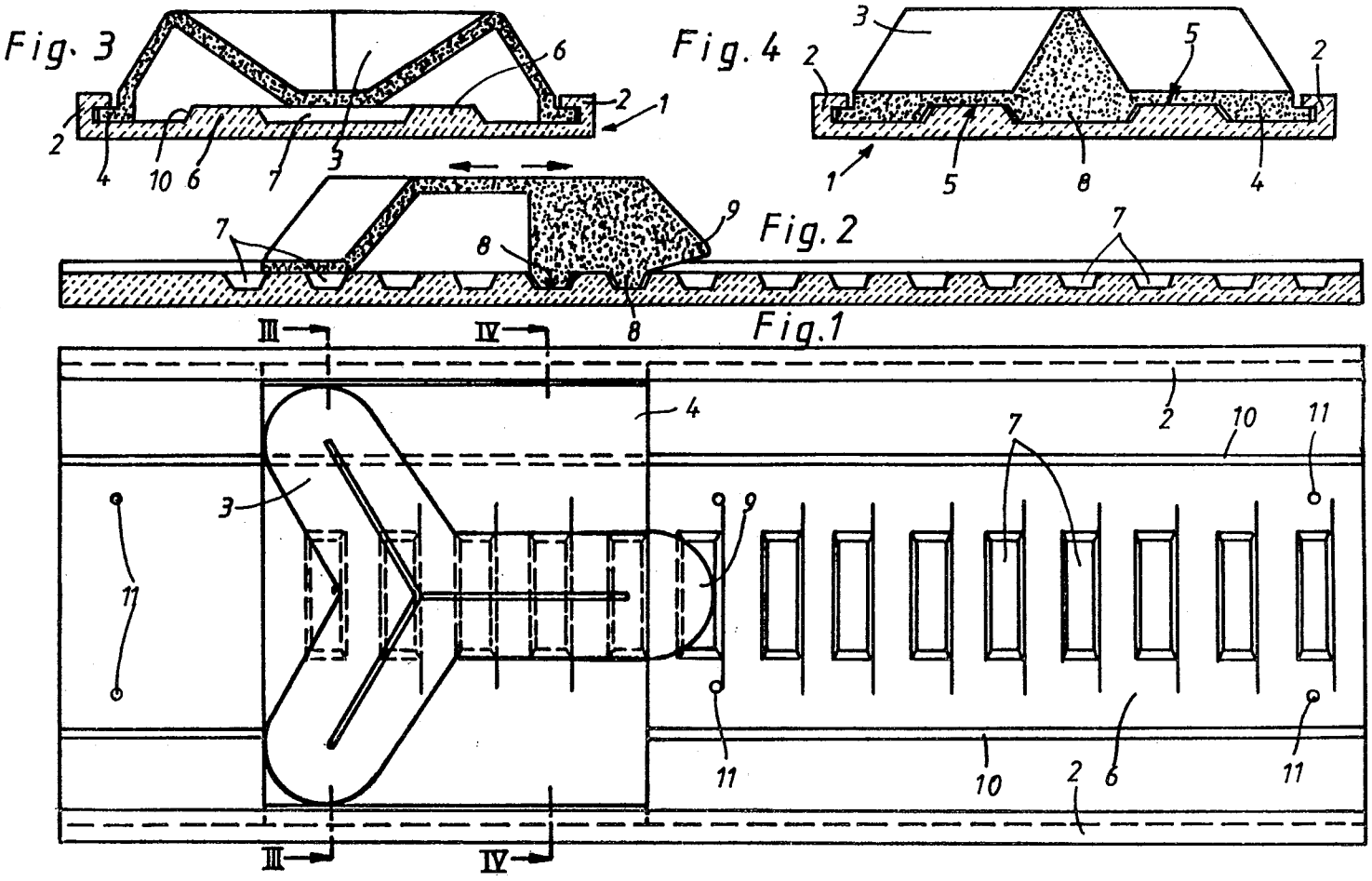

III
IV

CROSS-COUNTRY SKI BINDING

The invention concerns a binding and a ski shoe for use with a cross-country ski, the binding comprising a heel part fixed to the ski and adapted to grip the ski shoe at its heel.

In such bindings, the heel part including one or a plurality of concave or convex areas matching opposing convex or concave areas on the sole of the ski shoe, is always firmly attached to the ski so that when mounting the binding on the ski, the heel part must be adjusted according to the ski shoes to be used with it.

This leads to considerable difficulties in renting skis, as it is practically only possible, to rent skis provided with bindings corresponding to the most usual shoe sizes, unless frequent remountings of the heel part are carried out. This, apart from the time necessary to carry out such work, has a negative effect on cross-country skis on account of their relatively fragile construction. Since the heel part is usually screwed on, a frequent remounting of the heel part leads to a considerable weakening of the skis and increases the danger of breaking.

The aim of the invention is to provide a binding of the type referred to above, which allows the simple fitting of the heel part for differing shoe sizes, without leading to a weakening of the ski.

This is achieved, according to the invention with a heel part arranged on a bearing plate or preferably integral therewith. The heel part is slidably mounted in a guiding part affixed to the ski in its longitudinal direction, so that the heel part can be slidably adjusted in the longitudinal direction of the ski and fixed. The guiding part can be firmly attached to the ski, whereby the adjustment for the shoe sizes takes place by moving the heel part which is attached to the bearing plate.

If desired, the fixing of the bearing plate in the guiding part can be achieved by friction alone.

In order to avoid damaging the guiding part, for example by direct or glancing blows of the binding on hard objects such as roots, ice lumps, stones or the like during skiing, it is of advantage if the guiding part is a plate and grips the bearing plate along the longitudinal edges of said bearing plate.

It is of particular advantage if the guiding part fixed to the ski comprises a plurality of depressions arranged transverse to the running direction of the ski, in which at least one projection arranged on the bearing plate engages, preferably in the form of a cross bar. These cross bars can preferably be in the form of a truncated pyramid. In this way, the adjusted relative position of the guiding part and the bearing plate can be reliably maintained in a simple manner, using no loose parts. In addition, this makes it possible to allow for differences in the dimensions of the shoe soles. This is easy to achieve in that the dimension of each depression extending in the running direction of the ski or the guiding part exceeds the corresponding dimension of the projection(s), particularly the cross bars of the bearing plate, and preferably that the dimension of the depressions transverse to the running direction exceeds that of the projection(s), whereby in addition a sideways clearance assures the engaging of the projections—which may be in the form of studs of preferably truncated form also—in the depressions, even if the latter are partly filled with dirt. It is of course also possible to provide the guiding part with convex portions and the bearing plate with corresponding depressions, the convex portions having preferably converging convex surface lines, i.e. are in the form of truncated cones or pyramids.

The distance between the depressions is preferably that of the difference in length of sole of one shoe size to the next.

It is preferable that the bearing plate should be formed of an elastic material, such as synthetic material, and the projections(s) on the bearing plate be integral therewith, the bearing plate preferably having an extension or shoulder, the lower surface of which is raised with respect to the upper surface of the plate-shaped guiding part. In a ski binding according to the invention, it is possible to adjust the heel part without a tool. It suffices to lift the bearing plate by means of a coin or the like which may be inserted between the upper surface of the guiding part and the lower surface of the shoulder to such an extent that the projections are lifted out of the depressions.

A particularly advantageous form of the invention provides that the heel includes a raised portion in the form of a three-pointed star, the arms of which have a substantially gable-shaped cross-section, and the axes of which preferably enclose an angle of 120°, one of the arms preferably extending in the longitudinal direction of the ski and beyond the bearing plate, whereby the lower surface of this arm runs above the upper surface of the plate-shaped guiding part.

In order to assure especially under load conditions precise seating and precise lateral guiding of the bearing plate in the plate-shaped guiding part—said guiding part being preferably attached to the ski by means of a double-sided adhesive tape—a further feature of the invention provides that the lower surface of the bearing plate facing the plate-shaped guiding part is provided with a groove of trapezoid cross-section running in the longitudinal direction of the ski and corresponding with a raised part of trapezoid cross-section of the plate-shaped guiding part. It is to be regarded as a further advantage that the guiding part and the bearing plate are very thin and, therefore, do not have a negative effect on the behaviour of the ski.

The invention will become more apparent from the preferred embodiment illustrated in the drawings, wherein.

FIG. 1 shows a top view,

FIG. 2 a longitudinal section and

FIGS. 3 and 4 cross sections along line III—III and IV—IV in FIG. 1.

The plate-shaped guiding part 1 has, as can particularly be seen from FIGS. 3 and 4, longitudinal edges 2 which grip bearing plate 4 formed integrally with the star-shaped heel part 3.

The bearing plate 4 has on its underside facing the plate-shaped guiding part 1 a trapezoidal groove 5 extending in the longitudinal direction of the ski, which matches the raised part of trapezoidal cross-section 6 of the plate-shaped guiding part 1. This raised part includes a plurality of depressions 7 arranged transverse to the longitudinal axis of the ski and of the guiding part 1, the distance between them corresponding to the difference in length of the shoe sole from one shoe size to the next.

Cross bars 8 formed on the under surface of the bearing plate 4 can be engaged with these depressions 7, thus fixing the position of the bearing plate 4 with reference to the guiding part 1.

As can be seen from FIGS. 1 and 2, the arm of heel part 3 extending in the longitudinal direction of the ski and guide part 1, having a gable-shaped cross section like the other two arms, extends beyond the bearing plate 4. The lower surface of the arm extending beyond the bearing plate 4 encloses an acute angle with the upper surface of the guiding part 1, and forms an extension or shoulder 9. This extension or shoulder 9 can thus easily be raised by inserting beneath it a coin or a screwdriver, thus disengaging the cross bars 8 from the depressions 7, so that the bearing plate can be moved.

The depressions 7 and the cross bars 8 have the form of a truncated pyramid, whereby the cross bars engage loosely in the depressions 7. This ensures a reliable engagement of the cross bars 8 in the depressions 7 even if they are partly filled with dirt, and also compensates for differences in length of the shoe soles.

The exact support of the bearing plate 4 transverse to the longitudinal direction of the guiding part and the ski is assured by the slanting surfaces 10 of the raised part 6 of the guiding part 1, and the corresponding groove in the bearing plate 4.

The guiding part 1 is fixed to a ski preferably by means of a double-sided adhesive band, whereby pins can be inserted in the holes 11 in the ski to take up shearing forces.

The use of one cross bar 8 is possible instead of two, and it is also possible to form the bearing plate in such a manner that said bearing plate grips around the longitudinal edges of the plate-shaped guiding part. The heel part can be of any desired form, and the bearing plate can be fixed relative to the guiding part in any desired manner, for example by inserting pins or the like through the bearing plate to engage in the guiding part.

I claim:

1. A cross-country ski binding for use with a ski shoe having a recessed sole area, the binding comprising (a) a substantially plate-like guiding part affixed to the ski and having an upper surface extending longitudinally along the ski, the upper guiding part surface defining (1) a plurality of transversely extending depressions, (b) a bearing plate of elastic material longitudinally slidably mounted on the guiding part, the bearing plate including (1) a projection matching the depressions for selectively engaging a respective one of the depressions for retaining the bearing plate in a selected longitudinal position relative to the guiding part, and (2) an extension projecting longitudinally beyond the bearing plate and having an underside rising from the upper surface of the guiding part, and (c) a heel part arranged on the bearing plate and having a raised portion matching the recessed sole area for engagement therewith.

2. The cross-country ski binding of claim 1, wherein the heel part is integral with the bearing plate.

3. The cross-country binding of claim 1 or 2, further comprising a longitudinally extending guide means on the guiding part, the guide means gripping the bearing plate and slidably mounting the bearing plate on the guiding part.

4. The cross-country ski binding of claim 1 or 2, wherein the raised portion of the heel part has the shape of a three-armed star the arms of which are of substantially gable-shaped cross section, the axes of the arms enclosing angles of 120°.

5. The cross-country ski binding of claim 4, wherein one of the arms extends longitudinally beyond the bearing plate to form the extension.

* * * * *